United States Patent [19]

Wuerflein et al.

[11] 4,091,936

[45] May 30, 1978

[54] APPARATUS FOR EXTENDING A BOOM ASSEMBLY

[75] Inventors: James G. Wuerflein; Charles R. Spence, both of Winona, Minn.

[73] Assignee: The Warner & Swasey Company, Cleveland, Ohio

[21] Appl. No.: 742,009

[22] Filed: Nov. 15, 1976

[51] Int. Cl.[2] ..... B66C 23/62

[52] U.S. Cl. ..... 212/144; 212/8 R; 212/55; 212/59 R

[58] Field of Search ..... 212/8 R, 17, 35 R, 46 R, 212/46 A, 46 B, 55, 58 R, 59 R, 144

[56] References Cited

U.S. PATENT DOCUMENTS

| | | | |
|---|---|---|---|
| 3,366,250 | 1/1968 | Grove | 212/144 |
| 3,785,505 | 1/1974 | Keller, Jr. | 212/144 |
| 3,831,771 | 8/1974 | Wiencek | 212/55 |
| 3,944,082 | 3/1976 | Fritsch | 212/55 |
| 3,968,884 | 7/1976 | Johnson et al. | 212/55 |

FOREIGN PATENT DOCUMENTS

| | | | |
|---|---|---|---|
| 978,765 | 12/1964 | United Kingdom | 212/35 R |

OTHER PUBLICATIONS

Lorain, "Moto-Crane", MC-35H, Specifications by Koehring Lorain Division, 5/1975.

*Primary Examiner*—Lawrence J. Oresky

[57] ABSTRACT

The overall length of boom assembly can be increased by the use of a pair of boom extension sections. When the boom extension sections are not required, they are supported at storage locations adjacent to one side of a main boom assembly. When the overall length of the main boom assembly is to be increased, a first one of the boom extension sections is pivotally connected with the outer end portion of the main boom assembly and the second boom extension section is pivotally connected with the outer end portion of the first boom extension section. The two boom extension sections are swung outwardly together. After the first boom extension section has been firmly connected with the outer end portion of the main boom assembly, the second boom extension section is pivoted about the outer end portion of the first boom extension section. In order to guide movement of the second boom extension section from its storage position into engagement with the first boom extension section, a roller on the second boom extension section rolls along a track which is connected with the main boom assembly. As the second boom extension section is moved into engagement with the first boom extension section, the roller moves off the track to thereby release the second boom extension section.

13 Claims, 13 Drawing Figures

APPARATUS FOR EXTENDING A BOOM ASSEMBLY

BACKGROUND OF THE INVENTION

The present invention relates to a boom arrangement and more specifically to a method and apparatus for increasing the overall effective length of a boom assembly.

During operation of a boom assembly it is frequently desirable to increase the overall effective length of the boom assembly. To accomplish this, boom extension sections have previously been utilized. The boom extension sections have previously been stored alongside a main boom assembly to enable the relatively rugged main boom assembly to be used to lift heavy loads when the increased length is not required and to facilitate over-the-road transportation. Various arragements for increasing the overall length of a boom assembly by using one or more boom extension sections are disclosed in U.S. Pat. Nos. 3,125,227; 3,366,250; 3,698,569; 3,732,988, 3,785,505; 3,831,771; 3,885,677; 3,944,082 and 3,968,884. In addition to the disclosures in the aforementioned patents, it has been suggested that a pair of boom extension sections could be mounted beside the base section of a main boom assembly.

Whenever the effective length of a main boom assembly is to be increased by the use of boom extension sections, it is necessary to move the boom extension sections from their storage positions to operating positions in which they extend outwardly from the main boom assembly. In order to facilitate movement of one boom extension section from the storage position to its operating position, it has been suggested that the inner end of the one boom extension section be pivotally connected with the outer end of the boom assembly and swung into position in a manner shown in the aforementioned patents. However, when the effective length of a boom assembly is to be increased by the use of a pair of boom extension sections, difficulty has been encountered in positioning the second or outer one of the two boom extension sections.

SUMMARY OF THE PRESENT INVENTION

The present invention enables a pair of boom extension sections to be readily added onto a main boom assembly to increase the overall length of the boom assembly. When the boom extension sections are not being utilized, they are advantageously stored adjacent to the main boom assembly. A first or side fly boom extension section is supported in its storage position separately from a second or jib bom extension section to enable the side fly to be used while the jib remains stored. When both the side fly and jib are to be utilized, the inner end of the side fly is pivotally connected with the outer end of the main boom assembly. A roller and track arrangement is then utilized to guide movement of the inner end portion of the jib into engagement with the outer end of the side fly.

Once the side fly has been connected to the outer end of the main boom assembly and the jib connected with the side fly, the side fly is pivoted to an extended position and fixedly connected with the boom assembly. As the side fly is moved to the extended position, the jib is carried along with the side fly. Once the side fly has been fixedly connected with the main boom assembly, the jib is pivoted to an operating position in which it extends outwardly from the side fly. A gantry frame is then erected to hold the jib against movement relative to the side fly.

Accordingly, it is an object of this invention to provide a new and improved method and apparatus for use in extending a boom assembly with a pair of boom extension sections.

Another object of this invention is to provide a new and improved apparatus wherein connection of one boom section with another boom section is facilitated by the use of a track and follower arrangement to guide the relative movement between the boom sections, when the boom sections are interconnected, the follower is spaced apart from the track.

Another object of this invention is to provide a new and improved method and apparatus in which a first boom extension section is pivotal from a storage condition to an operating or extended condition with a second boom extension section disposed on the first boom extension section.

Another object of this invention is to provide a new and improved method and apparatus for extending a boom assembly and wherein first and second boom extension sections are pivotally interconnected, the first boom extension section is pivoted from a storage condition to an operating or extended condition while carrying the second boom extension section, and the second boom extension section is pivoted relative to the first boom extension to an operating condition extending outwardly from the first boom extension section.

Another object of this invention is to provide a new and improved method and apparatus as set forth in the next preceeding object wherein a roller and track arrangement is utilized to guide relative movement between the two boom extension sections when they are to be pivotally interconnected.

BRIEF DESCRIPTION OF THE DRAWINGS

The foregoing and other objects and features of the present invention will become more apparent upon a consideration of the following description taken in connection with the accompanying drawings wherein.

DESCRIPTION OF THE SPECIFIC PREFERRED EMBODIMENT OF THE INVENTION

Figure 1:
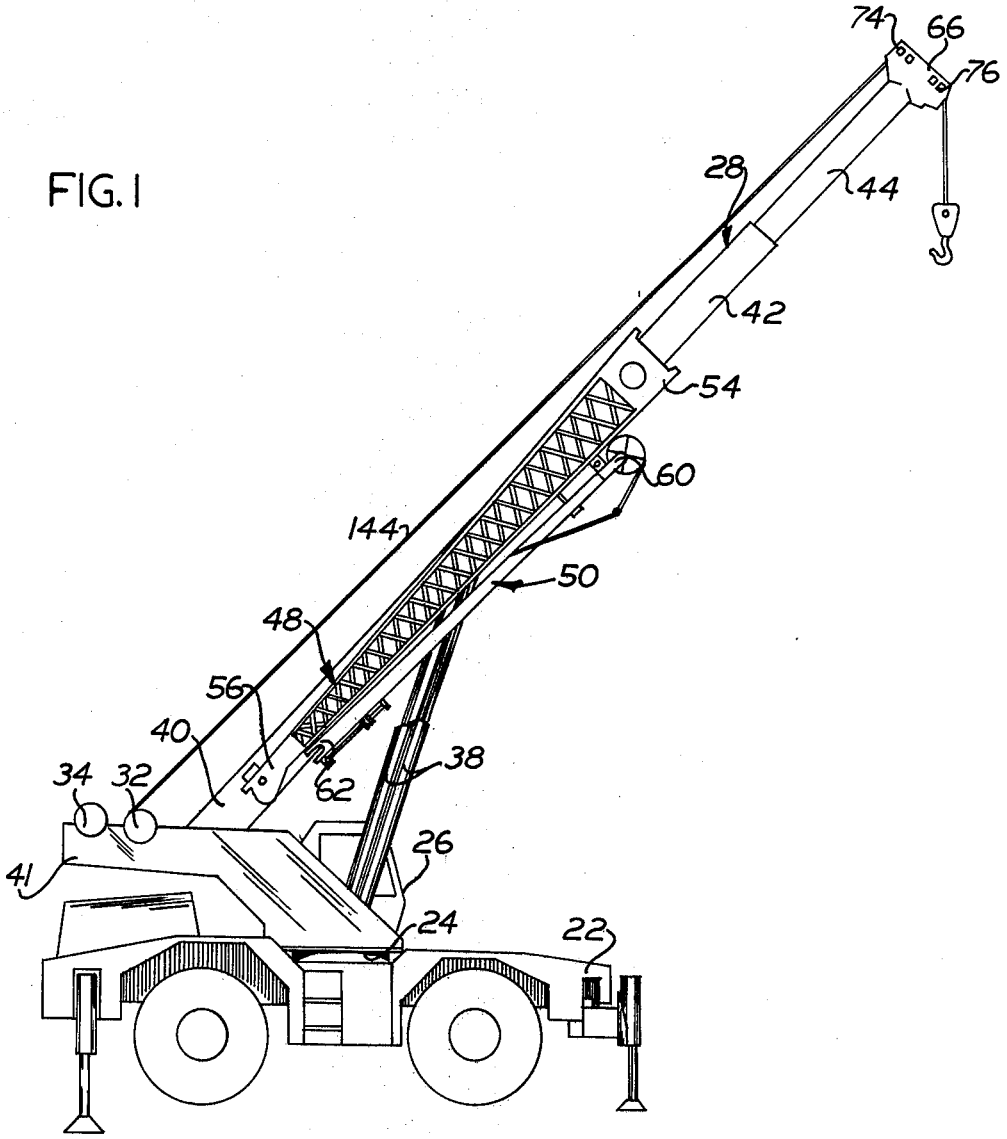
FIG. 1 is an elevational view of a crane having a main boom assembly and a pair of boom extension sections, the boom extension sections being illustrated in storage positions alongside the main boom assembly.

A crane 20 (FIG. 1) provided with a carrier 22 having a turntable 24 on which an operator's cab 26 and main boom assembly 28 are mounted. A main winch 32 and an auxiliary winch 34 are provided in association with the boom assembly 28.

The main boom assembly 28 is raised and lowered by a pair of piston and cylinder type hydraulic motors 38. The boom assembly 28 is of the telescopic type and has a first boom section 40 which is pivotally mounted on a base frame 41. A second boom section 42 is telescopically received within the first boom section 40. A third boom section 44 is telescopically received within the second boom section 42. Suitable hydraulic motors (not shown) are provided to move the boom sections 42 and 44 relative to each other and to the boom section 40 to vary the length of the boom assembly 28 in a known manner.

It is contemplated that under certain operating conditions it will be desirable to extend the overall effective length of the boom assembly 28. Accordingly, a side fly or first boom extension section 48 and a jib or second boom extension section 50 are provided. When the boom assembly 28 is to be utilized without the boom extension sections 48 and 50, the boom extension sections are stored alongside the first or base boom section 40 in the manner illustrated in FIG. 1. Of course, boom extension sections similar to the boom extension sections 48 and 50 could be utilized with main boom assemblies of a type other than the telescopic type.

When the two boom extension sections are in the stored condition of FIG. 1, the side fly 48 is disposed above and generally parallel to the jib 50. A base or inner end portion 54 of the side fly 48 is disposed adjacent to the outer end portion of the first section 40 of the main boom assembly 28. The side fly 48 is stored with the head or outer end portion 56 of the side fly adjacent to the pivotally mounted base of the boom section 40. The stored jib 50 has a head or outer end portion 60 adjacent to the outer end portion of the first section 40 of the main boom assembly 28 and the base 54 of the side fly 48. The base or inner end portion 62 of the jib 50 is stored adjacent to the base of the first boom section 40 and the head 56 of the side fly 48. As will become more apparent, storing the side fly 48 and jib 50 in a head-to-foot relationship enables them to be pivotally interconnected with each other and with the main boom assembly 28 and then swung from their stored condition to an extended or operating condition.

Figure 2:
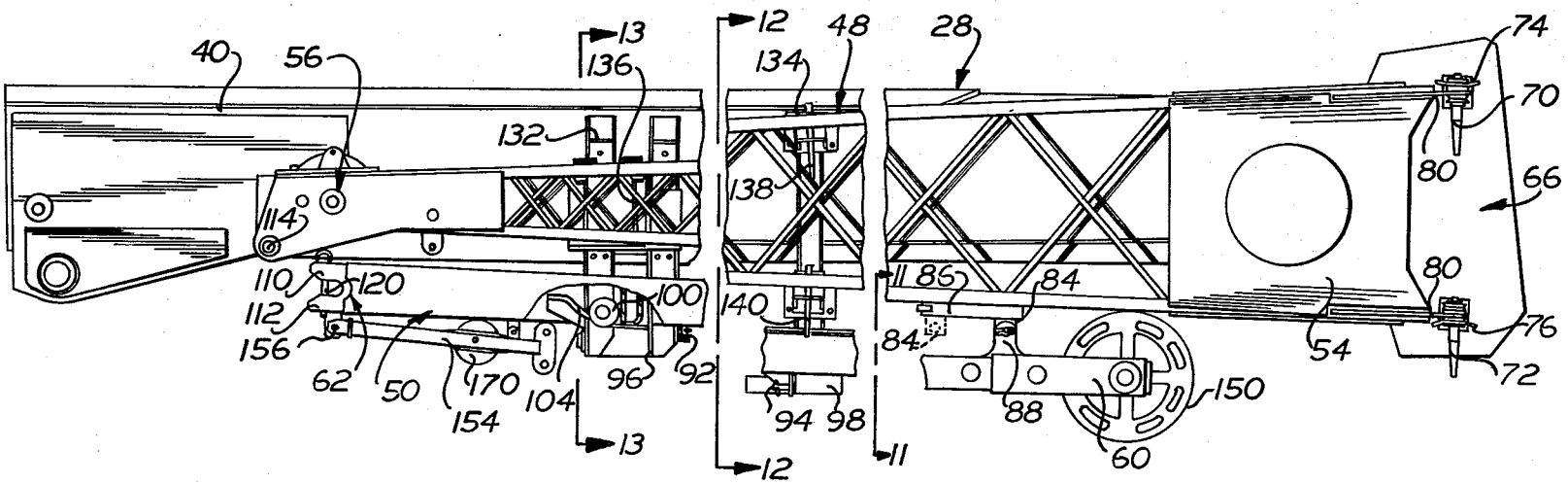
FIG. 2 is an enlarged fragmentary view further illustrating the relationship between the main boom assembly and the boom extension sections when the boom extension sections are stored alongside the main boom assembly.

When the side fly 48 and jib 50 are to be used to extend the main boom assembly 28, the main boom assembly is retracted to move a point or outer end portion 66 of the boom assembly 28 inwardly adjacent to the base 54 of the side fly 48 in the manner shown in FIG. 2. One side of the rectangular base 54 of the side fly 48 is then pivotally connected with one side of the point 66 of the outer or third boom section 44 with the main boom assembly 28 in the horizontal orientation shown in FIG. 2. To accomplish this, pins 70 and 72 are positioned in vertically aligned apertures formed in brackets 74 and 76 on the point 66 and through vertically aligned apertures formed in connector arms 80 at the base 54 of the side fly 48. It should be noted that there are four connector arms 80, one being disposed at each of the four corners of the base 54 of the side fly 48. At this time, the upper and lower connector arms 80 disposed adjacent to the main boom assembly 28 are connected with the brackets 74 and 76 on the point of the third boom section 44.

Figure 11:
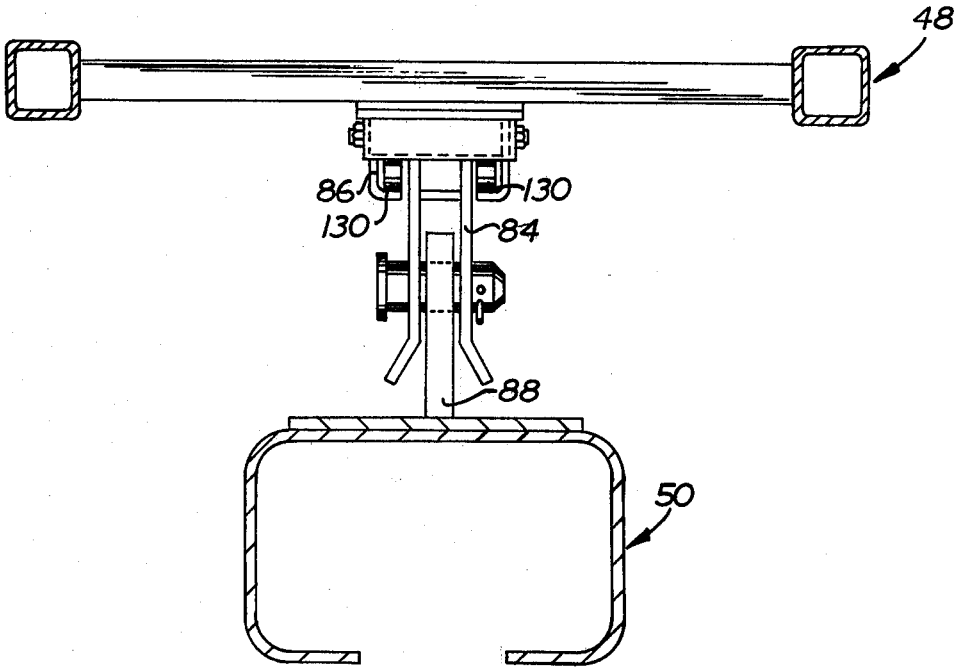
FIG. 11 is a sectional view, taken generally along the line 11—11 of FIG. 2, illustrating the manner in which one end portion of one boom extension section is supported on the other boom extension section.

In addition to pivotally connecting the side fly 48 to the outer end portion of the boom assembly 28, the inner end portion 62 of the jib 50 must be connected with the outer end portion 56 of the side fly 48. In accomplishing this it is first necessary to move a roller bracket 84 (FIG. 11) along a side fly mounted track 86 from a storage position illustrated in dashed lines in FIG. 2 to an operating position shown in solid lines in FIG. 2. When the roller bracket 84 has been moved to the operating or support position, it is connected with an upstanding bracket 88 which is on the head or outer end portion 60 of the jib 50. Retainer pins 92 and 94 are then disconnected to release the jib 50 from storage support brackets 96 and 98 connected to the base section 40 of the main boom assembly 28.

Figure 13:
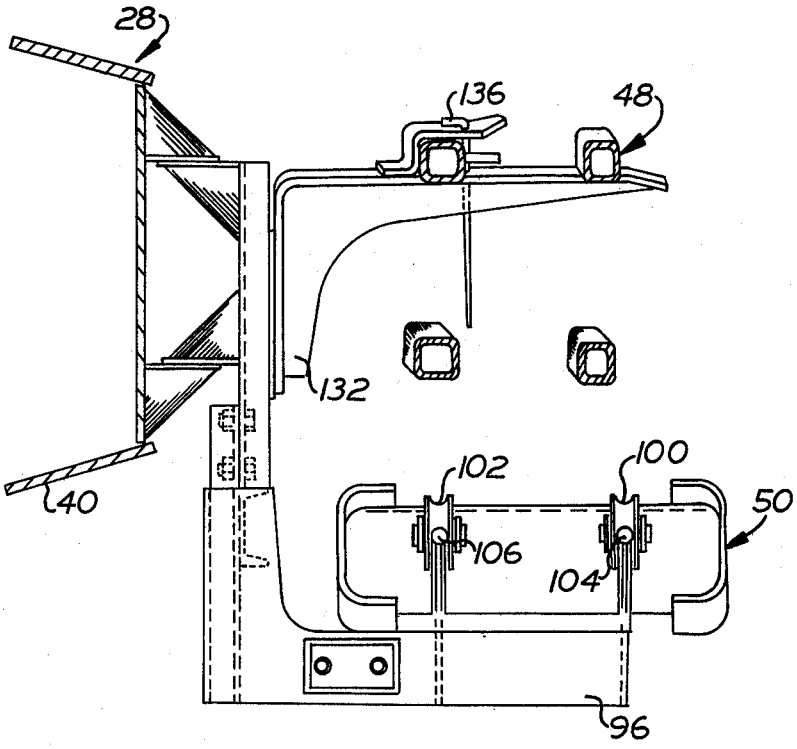
FIG. 13 is a sectional view, taken generally along the line 13—13 of FIG. 2, illustrating the relationship between a pair of rollers and a pair of tracks which are utilized to guide movement of one of the boom extension sections relative to the other boom extension section.

To move the inner or base end portion 62 of the jib 50 into engagement with the outer or head end portion 56 of the side fly 48, the main boom assembly 28 is raised from the horizontal orientation (shown in FIG. 2) to a position in which it extends at approximately 35° to a horizontal plane. This causes the jib 50 to move longitudinally downwardly toward the outer end portion 56 of the side fly 48 under the influence of gravity. As this is occurring, the jib 50 is moved sideways toward the side fly 48 by cooperation between a pair of rollers 100 and 102 (FIG. 13) and a pair of tracks 104 and 106. Thus, the jib 50 is simultaneously moved longitudinally toward the left (as viewed in FIG. 2) and sidewardly toward the side fly 48 (that is upwardly as viewed in FIG. 2).

As the rollers 100 and 102 approach the leftward (as viewed in FIG. 2) ends of the tracks 104 and 106, generally U-shaped spaces between upper and lower pairs of connector arms 110 and 112 on the inner end portions 62 of the jib 50 move into alignment with a pivot shaft 114 extending outwardly from opposite sides of the outer end portion 56 of the side fly 48. It should be noted that although only one arm 110 and 112 of each of the pairs of arms is shown in FIG. 2, there are two upper arms 110 and two lower arms 112 which engage the pivot shaft 114 on opposite sides of the outer end portion 56 of the side fly 48. In addition, it should be noted that prior to movement of the jib 50 away from the storage position of FIG. 2, a pair of pins 120 were removed from between the upper and lower arms 110 and 112 to enable the pivot shaft 114 to be received in the spaces between the upper and lower arms.

The tracks 104 and 106 have sloping central portions 124 which extend upwardly (as viewed in FIG. 3) toward the side fly 48 in a direction away from an outer end portion 126 of the tracks toward inner end portions 128 of the tracks. As the rollers 100 and 102 move along the tracks 104 and 106, the sloping central portions 124 of the tracks move the jib 50 sidewardly toward the side fly 48. As this is occurring, the jib 50 pivots about the connection between the upstanding bracket arm 88 and the roller bracket 84 (FIG. 2) and the roller bracket 84 moves leftwardly (as viewed in FIG. 2) along the track 86.

Figure 3:
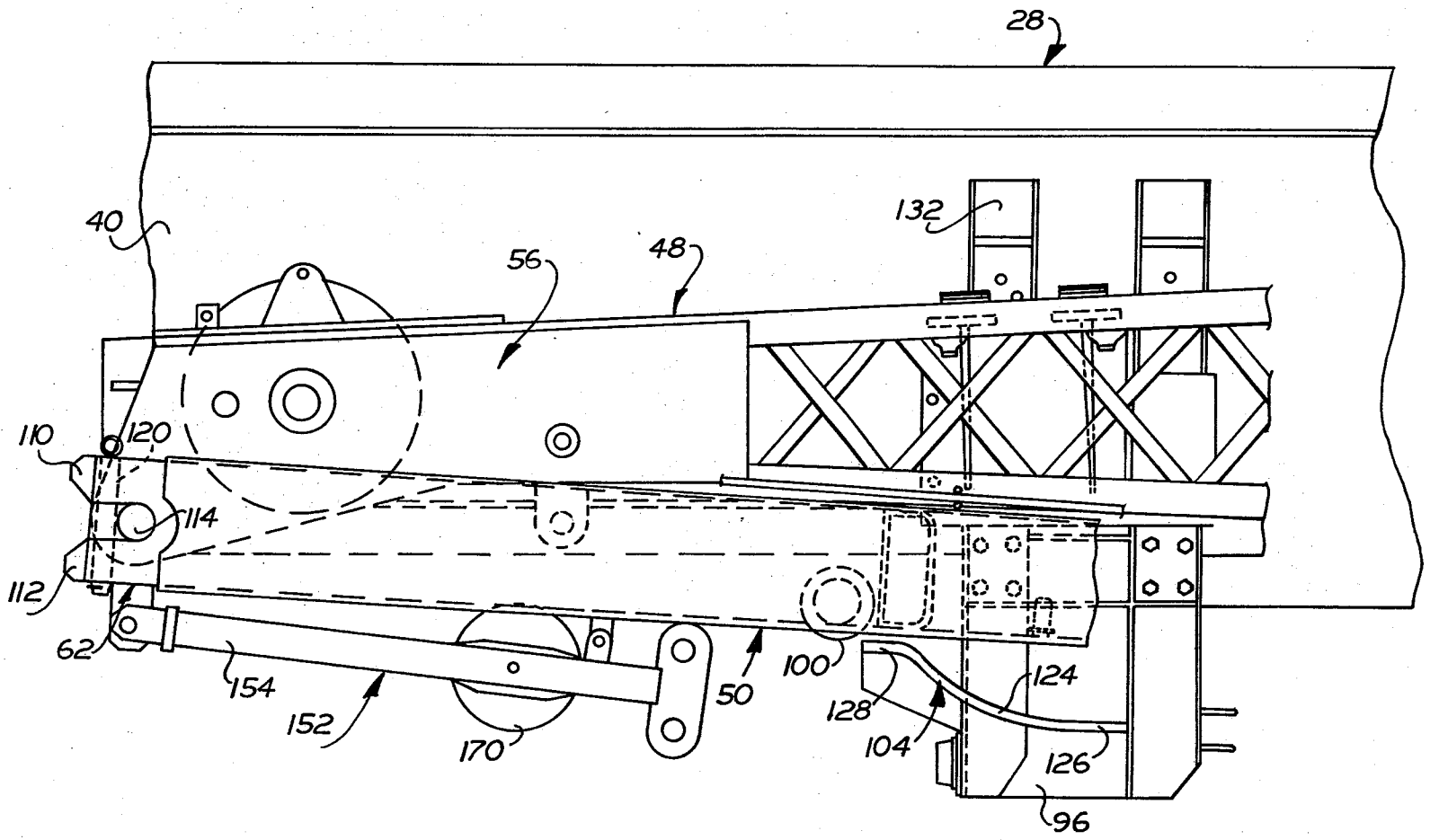
FIG. 3 is a further enlarged fragmentary view illustrating the manner in which end portions of the two boom extension sections are pivotally interconnected prior to movement of the boom extension sections from the stored condition of FIG. 1.

As the rollers 100 and 102 approach the leftward ends (as viewed in FIG. 2) of the tracks 104 and 106, the pivot shaft 114 enters the recesses between the arms 110 and 112 (see FIG. 3). As the jib 50 continues to move under the influence of gravity, the end portion 62 of the jib is supported by engagement of the arms 110 and 112 with the pivot shaft 114. During this portion of the longitudinal and sideward movement of the jib 50, the rollers 100 and 102 move clear of the tracks 104 and 106 (FIG. 3). When the arms 110 and 112 have been moved into the position shown in FIG. 3, spacer blocks are inserted between the arms and the connector pins 120 are moved into place to pivotally connect the inner end portion 62 of the jib 50 with the outer end portion 56 of the side fly 48.

During the combined longitudinal and sideward movement of the jib 50, the trailing end portion 60 of the jib is supported by the roller hanger bracket 84. The roller hanger bracket 84 has a pair of rollers 130 (FIG. 11) which move along the track 86 from the position shown in solid lines in FIG. 2 to the position shown in dashed lines in FIG. 2 as the end portion 62 of the jib moves from the storage position of FIG. 2 to the intermediate position of FIG. 3. It should be noted that at this time the jib 50 is no longer connected to the boom assembly 28 and is supported in its intermediate position on the side fly 48 by the pivot shaft 114 and by the roller bracket 84.

Figure 12:
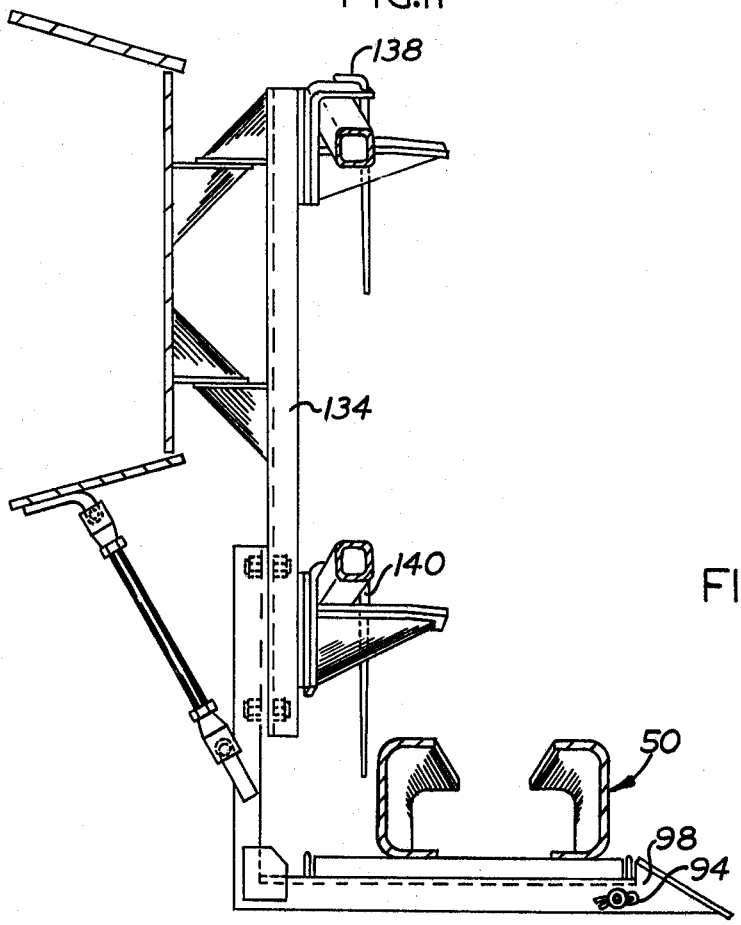
FIG. 12 is a sectional view, taken generally along the line 12—12 of FIG. 2, illustrating the manner in which the boom extension sections are separately supported and held in the storage positions of FIG. 1.

Once the inner end portion 62 of the jib 50 has been pivotally connected with the outer end portion 56 of the side fly 48, the side fly is disconnected from storage support brackets 132 and 134 (FIGS. 2, 12 and 13) mounted on the first boom section 40. This is accomplished by lowering the boom assembly 28 back to the horizontal position of FIG. 2 and removing a plurality of retainer pins 136, 138 and 140. When the retainer pins 136, 138 and 140 have been removed, the side fly 48 and jib 50 can be moved together relative to the main boom assembly 28.

Figure 4:
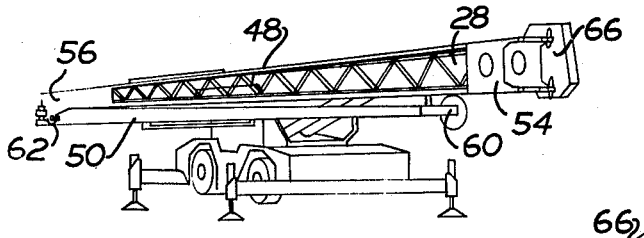
FIG. 4 is an illustration (on a reduced scale) depicting the manner in which a first one of the boom extension sections is pivoted from its storage position of FIG. 1 toward an operating position while the second boom extension section is carried on the first boom extension section.

The side fly 48 is pivoted about the outer end portion 66 of the main boom assembly 28 from the storage position shown in FIG. 2 to an extended or operating position in which the side fly 48 is aligned with and extends outwardly from the outer end of the boom assembly 28. To accomplish this, the outer end portion 56 of the side fly is then manually pulled to move the side fly along a horizontal arcuate path (FIG. 4) having its center at a vertical axis extending through the pivot pins 70 and 72 (FIG. 2).

As the side fly 48 moves along the arcuate path, the jib 50 is carried by the side fly. At this time, the jib 50 is suported in its intermediate position (FIG. 4) by the roller hanger 84 and the pivot connection between the inner end 62 of the jib 50 and the outer end 56 of the side fly.

When the side fly has been moved through an arcuate distance of approximately 180°, the outwardly extending arms on the side of the base 54 of the side fly opposite from the arms which are pivotally connected with the point 66 of the boom assembly 28, move into engagement with brackets on the opposite side (as viewed in FIG. 2) of the point 66 of the boom assembly 28. The side fly is then fixedly secured to the boom assembly 28 by means of anchor pins similar to the anchor pins 70 and 72.

Figure 5:
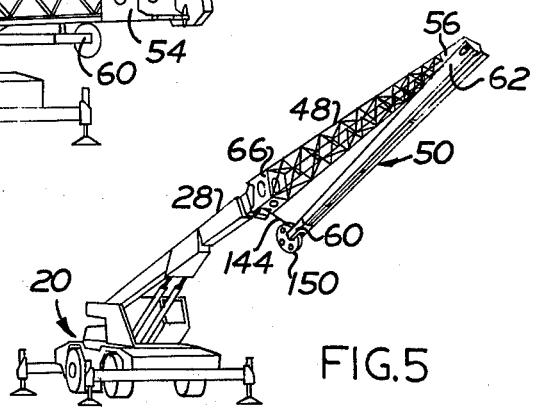
FIG. 5 is an illustration depicting the first boom extension section in its operating position extending outwardly from the main boom assembly and the initial movement of the second boom extension section toward its operating position.
Figure 6:
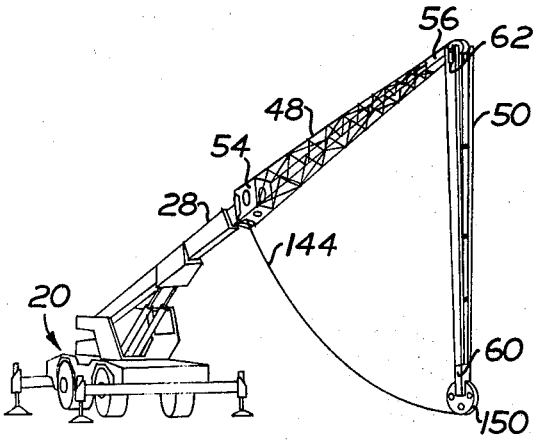
FIG. 6 is an illustration depicting the relationship between the two boom extension sections after the second boom extension section has been moved part way to its operating position.

After the side fly 48 has been moved to its operating position extending outwardly from the boom assembly 28, the jib 50 is moved from its intermediate position supported beneath the side fly to its operating position extending outwardly from the side fly. To accomplish this, the boom assembly is first raised to the position shown in FIG. 5. A which line 144 is then released to enable the inner end portion 62 of the jib 50 to pivot about a horizontal axis at its connection with the outer end portion 56 of the side fly 48 under the influence of gravity. This is accomplished by paying out the winch line 144 to enable the jib 50 to slowly pivot away from the side fly 48 along a vertical arcuate path to the orientation shown in FIG. 6.

A skid or shield 148 (see FIG. 8) is mounted around the outer end of a jib sheave 150. The jib is then manually pulled outwardly from the position shown in FIG. 6. At the same time the boom assembly 28 is lowered so that the skid 148 slides along the ground as the jib continues its pivotal movement. This pivotal movement of the jib along a vertical arcuate path is interrupted when the side fly 48 and jib 50 are aligned with each other in the manner shown in FIG. 7.

Figure 7:
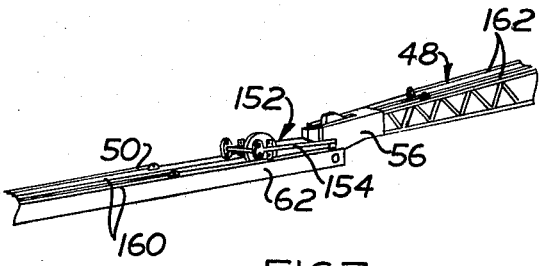
FIG. 7 is an illustration of a disconnected gantry frame which is utilized to hold the second boom extension section against movement relative to the first boom extension section when they are both in their operating or extended positions.
Figure 8:
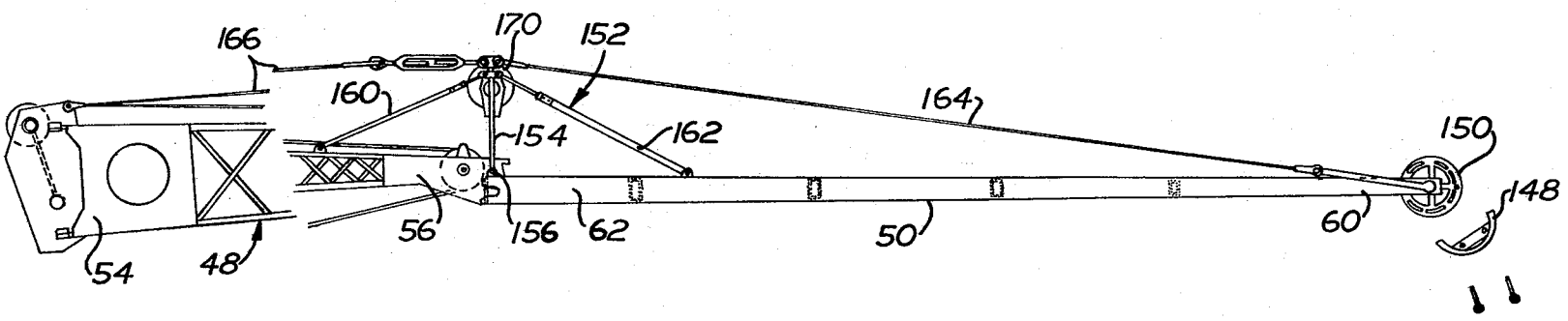
FIG. 8 is a fragmentary illustration depicting the two boom extension sections in their operating positions with the gantry frame connected to hold the boom extension sections against movement relative to each other.

A gantry frame 152 is then erected from the disconnected or collapsed condition of FIG. 7 to the connected or upright condition of FIG. 8 to hold the jib 50 against movement relative to the side fly 48. The gantry frame 152 includes a central frame 154 which is pivotally connected at 156 with the jib 50. The frame 154 is pivoted from the lowered position of FIG. 7 to the raised position of FIG. 8 and support rods 160 and 162 are connected to hold the support frame 154 in position. Front and rear jib pendants 164 and 166 are then connected to further hold the central portion 154 of the gantry frame 152 upright.

Once the gantry frame 152 has been erected to hold the jib in the desired orientation relative to the side fly 48, the skid 148 is removed. The winch line 144 is extended through a sheave 170 on the central portion of the gantry frame 152 and over the sheave 150 at the outer end portion 60 of the jib 50 (see FIG. 8).

Figure 9:
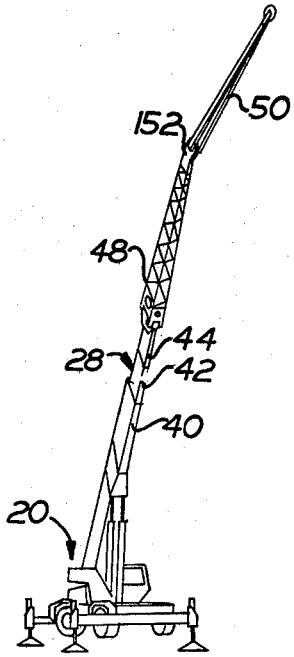
FIG. 9 is an illustration depicting the manner in which the main boom assembly of FIG. 1 is extended by the use of the two boom extension sections.

The crane 20 can then be utilized with the boom assembly 28 extended by the side fly 48 and jib 50 in the manner illustrated in FIG. 9. It should be noted that the telescopic relationship between the boom sections 40, 42 and 44 can be varied at this time to thereby raise and lower the side fly 48 and jib 50. It should also be noted that the angular orientation of the jib 50 relative to the side fly 48 can be adjusted by adjusting the length of the gantry frame pendants 164 and 166 and support rods 160 and 162.

When the work requiring the use of the side fly 48 and jib 50 has been completed, the side fly and jib are returned to their storage positions by reversing the steps previously set forth in erecting the side fly and jib. It should be noted that both the erecting and storing of the side fly 48 and jib 50 is facilitated due to the fact that the jib is pivotally connected with the side fly and is carried with the side fly as it pivots between its operating and storage positions. Once the side fly and jib have been returned to their storage positions, the boom assembly 28 and boom extension sections 48 and 50 are compactly arranged to facilitate over-the-road movement of the crane 20.

Figure 10:
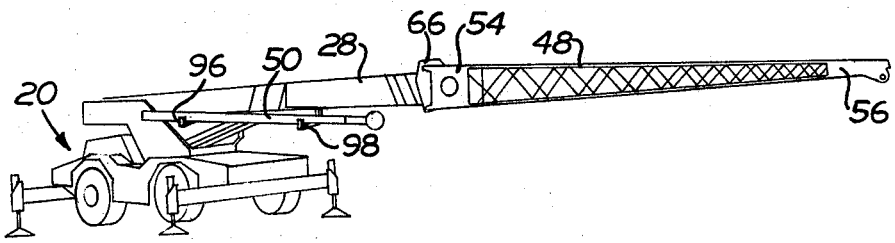
FIG. 10 is an illustration depicting the use of only one of the boom extension sections, the other boom extension section being illustrated in its stored position.

It is contemplated that under certain conditions it will be desirable to use only the side fly 48. Under these circumstances the side fly 48 is erected in the manner shown in FIG. 10 while the jib 50 remains in its storage position on the brackets 96 and 98 connected with the base or first boom section 40. The side fly 48 is moved from the storage position of FIG. 2 to the operating position of FIG. 10 extending outwardly from the boom assembly 28 by pivotally connecting the inner end portion 54 of the side fly 48 with the point 66 of the boom assembly 28, disengaging the retaining pins 136, 138 and 140, swinging the side fly 48 outwardly to its operating position, and connecting the anchor pins to the opposite side of the point 66 of the boom assembly 28. It should be noted that this is done without connecting the jib 50 with the side fly so that the jib remains in its storage position as illustrated in FIG. 10.

In view of the foregoing description it is apparent that a pair of boom extension sections 48 and 50 can be readily added onto a main boom assembly 28 to increase the overall length of the main boom assembly. When the boom extension sections 48 and 50 are not being utilized, they are advantageously stored adjacent to the main boom assembly in the manner shown in FIG. 2. The side fly boom extension section 48 is supported in its storage position on brackets 132 and 134 connected to the boom assembly 28. The jib 50 is supported separately from the side fly 48 on brackets 96 and 98 to enable the side fly to be used while the jib remains stored. When both the side fly and jib are to be utilized, the inner end portion 54 of the side fly 48 is pivotally connected with the outer end portion 66 of the main boom assembly 28. Rollers 100 and 102 and tracks 104 and 106 are utilized to guide movement of the inner end portion 62 of the jib 50 into engagement with the outer end portion 56 of the side fly 48.

Once the side fly 48 has been connected to the outer end 66 of the main boom assembly 28 and the jib 50 connected with the side fly, the side fly is pivoted to an extended position and fixedly connected with the boom assembly. As the side fly 48 is moved to the extended position, the jib 50 is carried along with the side fly. Once the side fly 48 has been fixedly connected with the main boom assembly 28, the jib 50 is pivoted to an operating position in which it extends outwardly from the side fly. A gantry frame 152 is then erected to hold the jib 50 against movement relative to the side fly 48.

Although the rollers 100 and 102 have been disclosed herein as being rotatably connected to the jib 50 and the tracks 104 and 106 disclosed as being fixedly connected to the main boom assembly 40, it is contemplated that their locations could be reversed. It is also contemplated that the roller and track guide arrangement could be utilized in environments other than the specific environment disclosed herein.

Having described specific preferred embodiments of the invention, the following is claimed:

1. An apparatus comprising a first longitudinally extending boom section having an inner and outer end portions, a second longitudinally extending boom section having inner and outer end portions, said second boom section being movable relative to said first boom section between a storage condition, an intermediate condition and an operating condition, said second boom section being disposed to one side of said first boom section with the inner end portion of said second boom section located adjacent to and spaced axially inwardly of the outer end portion of said first boom section and with the outer end portion of said second boom section located adjacent to the inner end portion of said first boom section when said second boom section is in said storage condition, said second boom section being disposed on said one side of said first boom section with the inner end portion of said second boom section pivotally connected with the outer end portion of said first boom section when said second boom section is in said intermediate condition, said second boom section extending outwardly of said first boom section with said inner end portion of said second boom section connected with said outer end portion of said first boom section when said second boom section is in said operating condition, said boom assembly further comprising connecting means for pivotally connecting said inner end portion of said second boom section with said outer end portion of said first boom section to enable said second boom section to be pivoted from said intermediate condition to said operating condition, means for guiding movement of said second boom section between said storage and intermediate conditions, said means for guiding movement of said second boom section including track means connected with one of said boom sections and follower means connected with the other of said boom sections for engaging said track means, said track means having inner and outer end portions with an intermediate portion which extends away from said inner end portion of said track means toward said outer end portion of said track means in a direction toward the central axis of said first boom section, said follower means being disposed in engagement with the intermediate portion of said track means to guide movement of said second boom section toward said first boom section during a portion of the movement of said second boom section from said storage condition to said intermediate condition, said follower means being spaced apart from said track means when said second boom section is in said intermediate condition to enable said second boom section to be pivoted from said intermediate condition to said operating condition without interference between said track means and said follower means.

2. An apparatus as set forth in claim 1 further including support means interconnecting said first boom section and the outer end portion of said second section at a location adjacent to the inner end portion of said first boom section for supporting the outer end portion of said second boom section during movement of said second boom section from said storage condition to said intermediate condition.

3. An apparatus as set forth in claim 1 wherein said connecting means includes means for supporting said second boom section for pivotal movement about a generally horizontal axis extending perpendicular to a central axis of said first boom section.

4. A boom assembly as set forth in claim 1 wherein said track means is connected with said first boom section, said follower means including roller means connected with said second boom section for engaging said track means and holding said second boom section against sidewise movement relative to said track means during movement of said second boom section from said storage condition to said intermediate condition.

5. An apparatus comprising a boom assembly, a first boom extension section movable between a storage condition adjacent to one side of said boom assembly and an operating condition extending outwardly from said boom assembly to thereby extend said boom assembly, a second boom extension movable between a storage condition adjacent to said one side of said boom assembly and an operating condition extending outwardly from said first boom extension section when said first boom extension section is in its operating condition to thereby further extend said boom assembly, first support means connected with said boom assembly for supporting said first boom extension section in its storage condition, first connector means for pivotally connecting an inner end portion of said first boom extension section with said boom assembly for pivotal movement between the storage and operating conditions of said first boom extension section, second support means connected with said boom assembly for supporting said second boom extension section in its storage condition when said first boom extension section is in its operating condition and when said first boom extension is in its storage condition, said second boom extension section being disposed to one side of the path of pivotal movement of said first boom extension section between its storage and operating conditions when said second boom extension section is in its storage condition, third support means for supporting said second boom extension section in an intermediate condition adjacent to one side of said first boom extension section for movement therewith as said first boom extension section moves from its storage condition to its operating condition, said third support means including second connector means for pivotaly connecting an inner end portion of said second boom extension section with an outer end portion of said first boom extension section for pivotal movement between the intermediate and storage conditions of said second boom extension section when said first boom extension section is in its operating condition whereby a load can be supported from the first boom extension section when it is in its operating condition and whereby a load can be supported from the second boom extension section when it is in its operating condition.

6. An apparatus as set forth in claim 5 wherein said first connector means supports said first boom extension section for movement from its storage condition to its operating condition along a first arcuate path, said first arcuate path having its center at the outer end portion of said boom assembly, said second connector means supporting said second boom extension section for movement from its intermediate condition to its operating condition along a second arcuate path, said second arcuate path having its center at the outer end portion of said first boom section.

7. An assembly as set forth in claim 6 wherein said second arcuate path extends perpendicular to said first arcuate path.

8. An apparatus as set forth in claim 5 wherein said first connector means includes means for supporting said first boom extension section for pivotal movement about a first axis and said second connector means includes means for supporting said second boom extension section for pivotal movement about a second axis extending perpendicular to said first axis.

9. An apparatus as set forth in claim 5 further including track and roller means connected with said boom assembly and said second boom extension section for guiding movement of said second boom extension section from its storage condition toward its intermediate condition.

10. An apparatus as set forth in claim 9 wherein said track and roller means includes a track and a roller, said track and roller being spaced apart when said second boom extension section arrives at its intermediate condition upon movement of said second boom extension section from its storage condition to its intermediate condition.

11. An apparatus as set forth in claim 5 further including frame means for holding said second boom extension section against movement relative to said first boom extension section when said first and second boom extension sections are in their operating conditions, said frame means being movable between a connected condition in which said frame means is effective to hold said second boom extension section against movement relative to said first boom extension section and a disconnected condition in which said frame means is ineffective to hold said second boom extension section against movement relative to said first boom extension section, said frame means being in its disconnected condition when said second boom extension section is in its intermediate condition, at least a portion of said frame means being connected with said second boom extension section for movement therewith between the intermediate and operating conditions of said second boom extension section.

12. An apparatus as set forth in claim 5 wherein said boom assembly includes a plurality of telescopically mounted boom sections including a base boom section and an outer boom section, said first and second support means being connected with said base boom section, said first connector means being operable to pivotally connect the inner end portion of said first boom extension section with the outer end portion of said outer boom section when said plurality of boom sections are telescopically retracted.

13. An apparatus comprising a boom assembly, a first boom extension section movable between a storage condition adjacent to one side of said boom assembly and an operating condition extending outwardly from said boom assembly to thereby extend said boom assembly, a second boom extension section movable between a storage condition adjacent to said one side of said boom assembly and an operating condition extending outwardly from said first boom extension section when said first boom extension section is in its operating condition to thereby further extend said boom assembly, first support means connected with said boom assembly for supporting said first boom extension section in its storage condition, first connector means for pivotally connecting an inner end portion of said first boom extension section with said boom assembly for pivotal movement between the storage and operating conditions of said first boom extension section, second support means connected with said boom assembly for supporting said second boom extension section in its storage condition when said first boom extension section is in its operating condition and when said first boom extension section is in its storage condition, said second boom extension section being disposed to one side of the path of pivotal movement of said first boom extension section between its storage and operating conditions when said second boom extension section is in its storage condition, third support means for supporting said second boom extension section in an intermediate condition adjacent to one side of said first boom extension section for movement therewith as said first boom extension section moves from its storage condition to its operating condition, said third support means including second connector means for pivotally connecting an inner end portion of said second boom extension section with an outer end portion of said first boom extension section for pivotal movement between the intermediate and storage conditions of said second boom extension section when said first boom extension section is in its operating condition and third connector means for connecting the outer end portion of said second boom extension section with the inner end portion of said first boom extension section for supporting the outer end portion of said second boom section during movement of said first boom extension section from its storage condition to its extended condition, means for guiding movement of said second boom extension section between said storage and intermediate conditions, said means for guiding movement of said second boom extension section including track means connected with one of said boom extension sections and follower means connected with the other of said boom extension sections for engaging said track means, said track means having inner and outer end portions with an intermediate portion which extends away from said inner end portion of said track means toward said outer end portion of said track means in a direction toward the central axis of said first boom extension section, said follower means being disposed in engagement with the intermediate portion of said track means to guide movement of said second boom extension toward said first boom extension section during a portion of the movement of said second boom extension section from said storage condition to said intermediate condition, said follower means being spaced apart from said track means when said second boom extension section is in said intermediate condition to enable said second boom extension section to be pivoted from said intermediate condition to said operating condition without interference between said track means and said follower means.

* * * * *